United States Patent [19]

Kaplan

[11] 4,341,611

[45] Jul. 27, 1982

[54] ALUMINA REDUCTION CELL

[75] Inventor: Howard I. Kaplan, Florence, Ala.

[73] Assignee: Reynolds Metals Company, Richmond, Va.

[21] Appl. No.: 217,774

[22] Filed: Dec. 18, 1980

[51] Int. Cl.[3] ..... C25C 3/08

[52] U.S. Cl. ..... 204/243 R; 204/294

[58] Field of Search ..... 204/67, 243 R–247, 204/294

[56] References Cited

U.S. PATENT DOCUMENTS

| | | | |
|---|---|---|---|
| 3,011,983 | 12/1961 | Rickes et al. | 252/520 |
| 3,785,941 | 1/1974 | Jacobs | 204/243 R X |
| 4,071,420 | 1/1978 | Foster, Jr. et al. | 204/67 |
| 4,093,524 | 6/1978 | Payne | 204/61 |
| 4,177,128 | 12/1979 | Rahn | 204/243 R |
| 4,181,583 | 1/1980 | Steiger et al. | 204/67 |
| 4,219,391 | 8/1980 | Foster, Jr. | 204/67 |
| 4,231,853 | 11/1980 | Rahn | 204/243 R |
| 4,243,502 | 1/1981 | Kugler | 204/294 X |
| 4,308,114 | 12/1981 | Das et al. | 204/67 |

*Primary Examiner*—Donald R. Valentine

*Attorney, Agent, or Firm*—Lyne, Girard & McDonald

[57] ABSTRACT

An improved alumina reduction cell is described in which the carbonaceous cathode includes refractory hard metal tiles forming the surface in contact with molten aluminum formed in the cell and intermediate tiles separating the refractory hard metal tiles from the carbonaceous cathode to prevent reaction between refractory hard metal tiles and the carbonaceous cathode in the presence of the molten aluminum.

26 Claims, 5 Drawing Figures

ALUMINA REDUCTION CELL

BACKGROUND OF THE INVENTION

Aluminum metal is conventionally produced by the electrolytic reduction of alumina dissolved in a molten cryolite bath according to the Hall-Heroult process.

This process for reducing alumina is carried out in a thermally insulated cell or "pot" which contains the alumina-cryolite solution. The cell floor, typically made of a carbonaceous material, provides some of the thermal insulation and serves as a part of the cathode. The cell floor may be made up of a number of carbonaceous blocks bonded together with a carbonaceous cement, or it may be formed using a rammed mixture of finely ground carbonaceous material and pitch. The anode, which usually comprises one or more carbonaceous blocks, is suspended above the cell floor.

Resting on the cell floor is a layer or "pad" of molten aluminum which the bath sees as the true cathode. The anode, which projects down into the bath, is normally spaced from the pad at a distance of 1.5 to 3.0 inches (3.81 to 7.62 centimeters). The alumina-cryolite bath is maintained on top of the pad at a depth of about 8.0 to 12.0 inches (20.32 to 30.48 centimeters).

As the bath is traversed by electric current, alumina is reduced to aluminum at the cathode and carbon is oxidized to its dioxide at the anode. The aluminum thus produced is deposited on the pad and tapped off periodically after it has accumulated.

For the electrolytic process to proceed efficiently, the alumina reduction should occur onto a cathode surface of aluminum and not the bare carbonaceous surface of the cell floor. Therefore, it is considered important for the pad to cover the cell floor completely.

As molten aluminum does not readily wet or spread thin on carbonaceous materials, the pad can best be visualized as a massive globule on the cell floor. In larger cells, the heavy currents of electrolysis give rise to powerful magnetic fields, sometimes causing the pad to be violently stirred and to be piled up in selected areas within the cell. Therefore, the pad must be thick enough so that its movements do not expose the bare surface of the cell floor. Additionally, the anode must be sufficiently spaced from the pad to avoid short circuiting and to minimize reoxidation of aluminum.

Still, the movements of the pad have adverse effects which cannot be readily controlled. For a given cell operating with a particular current of electrolysis, there is an ideal working distance between the cathode and the anode for which the process will be most energy efficient. However, the required spacing of the anode due to the turbulence of the pad prevents this ideal working distance from being utilized. Further, since the pad is in a state of movement, a variable, uneven working distance is presented. This variable working distance can cause uneven wear or consumption of the anode. Pad turbulence can also cause an increase in back reaction or reoxidation at the anode of cathodic products, which lowers cell efficiency. In addition, pad turbulence leads to accelerated bottom liner distortion and degradation through thermal effects and through penetration by the cryolite and its constituents.

It has been suggested in the literature and prior patents that certain special materials, such as refractory hard metals (RHM), most notably titanium diboride ($TiB_2$) can be used advantageously in forming the cell floor.

Ideally, in contrast to conventional carbon products, these materials are chemically compatable with the electrolytic bath at the high temperatures of cell operation and are also compatible chemically with molten aluminum.

Also, with these special materials, the electrical resistance across the interface between the molten aluminum and the cell floor is much lower than where the cell floor is formed by bare carbon. Thus, it should be possible to operate the cell with reduced electrical power requirements.

Furthermore, the special cell floor materials are wetted by molten aluminum. Accordingly, the usual thick metal pad should no longer be required, and molten aluminum may be maintained on the cell floor as a relatively thin film. This can be conveniently carried out using a "drained cathode" configuration where molten aluminum is continuously drained off the cathode as the aluminum is electrolytically reduced.

By using a drained cathode design, the substitution of a relatively thin film of molten aluminum for the conventional metal pad eliminates a source of electrical resistance in the cell. In addition, the anode-cathode working distance across the bath can be shortened considerably by going to a drained cathode design, which would reduce the electrical resistance of the cell still further, and would also permit the most efficient anode-cathode working distance to be utilized.

With all of their benefits to the reduction process, there is a problem associated with the use of RHM tiles as the reduction cell floor. When attached to carbonaceous substrates, such as the carbonaceous cathode of a reduction cell, errosion occurs at the RHM tile-carbonaceous substrate interface in the presence of molten aluminum and electrolyte. It is believed that this errosion is primarily chemical in nature, with the molten aluminum wetting the tile surface and reacting with the carbon to form $Al_4C_3$ which then dissolves in the electrolyte. This sets up a mechanism for removal of carbon from the tile interface and below, causing detachment of the tiles from the cathode.

It is thus a primary object of the present invention to eliminate the cause of this reaction.

THE PRESENT INVENTION

By means of the present invention, the above-stated objective is obtained. According to the present invention, an intermediate tile is positioned between the refractory hard metal tile and the carbonaceous substrate. The material forming this intermediate tile should not react rapidly with the aluminum that will still wet the RHM tile surface. Furthermore, the intermediate material must be stable in the reduction cell environment. If the intermediate material is a good electrical conductor, the RHM tile can be pinned to the intermediate tile and electrical current will be transferred through the pin, as well as the RHM tile-intermediate tile interface, and then through the intermediate tile to the carbonaceous cathode. If the intermediate material is not a good electrical conductor, the connector between the RHM tile and the intermediate material must extend into the carbonaceous cathode and carry the electrical current.

BRIEF DESCRIPTION OF THE DRAWINGS

The alumina reduction cell of the present invention will be more fully described with reference to the drawings in which.

DETAILED DESCRIPTION OF THE PREFERRED EMBODIMENTS

Figure 1:
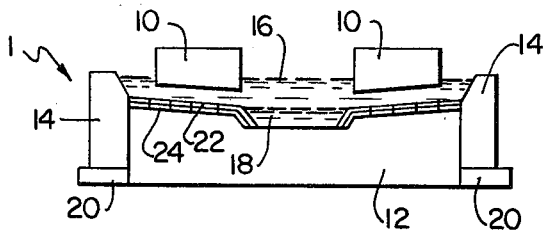
FIG. 1 is an end elevational view of an alumina reduction cell, with the end wall removed, according to the present invention.
Figure 2:
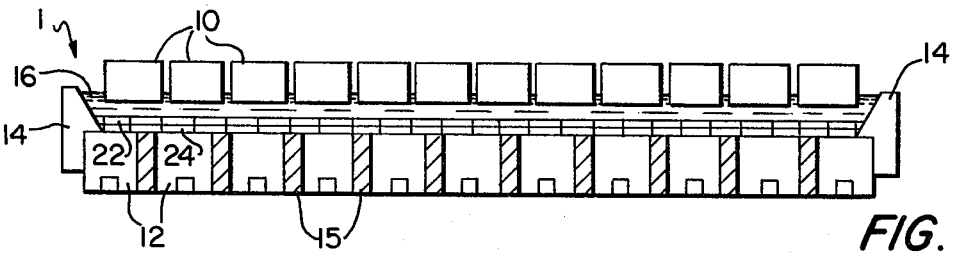
FIG. 2 is a side elevational view, with the side wall removed, of the reduction cell.

FIGS. 1 and 2 illustrate a drained cathode alumina reduction cell 1 employing the tile surface of the present invention. Anode blocks 10, formed from carbonaceous material, are suspended within a batch 16 of alumina dissolved in molten cryolite and are attached to a source of electrical current by means not shown. Carbonaceous cathode blocks 12 are joined together by a rammed mixture of pitch and ground carbonaceous material 15 and form the floor or bed of the cell 1. These cathode blocks 12 are connected by means of conductor bus bars 20 to the electrical current source to complete the electrical circuit. Outer walls 14 form the side and end supporting structures for the cell 1. The walls 14 may, for example, be formed from graphite blocks joined together with a graphitic cement.

As can best be seen in FIG. 1, the floor formed by the cathode blocks 12 and rammed mixture 15 includes a central trough having molten aluminum 18 carried within. The molten aluminum 18 extends slightly above the trough and covers the entire floor of the cell 1.

The carbonaceous blocks 12 and rammed mixture 15 forming the bottom of the cell 1 are covered along their upper surface with two layers of tiles, which tiles form the floor of the cell 1. Tiles 22, which form the surface in contact with the molten aluminum, are refractory hard metal (RHM) tiles, which may be formed of such materials as $TiB_2$, $TiB_2$-AlN mixtures, and other similar materials, typically by hot pressing RHM powders to form the tiles. These refractory hard metal materials are wetted by the molten aluminum 18 and thus permit the molten aluminum 18 to completely coat the floor of the cell 1.

To minimize cracking during use of these tiles, due to the brittleness of the RHM materials, the RHM tiles 22 may be reinforced with carbon, graphite, or silicon carbide fibers or particles, which are added to the powders forming these tiles 22 prior to hot pressing. When fibers are employed, the fibers may be random or uniform in length and are oriented in the plane perpendicular to the direction of hot pressing. The fibers or particles act to resist tensile stresses that could result in cracking during use.

Figure 3:
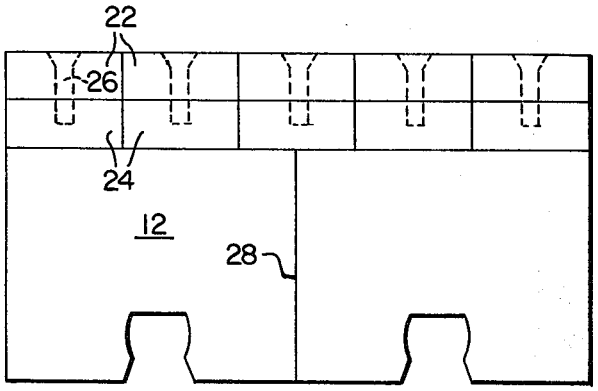
FIG. 3 is an expanded view of a reduction cell cathode according to the present invention.
Figure 4:
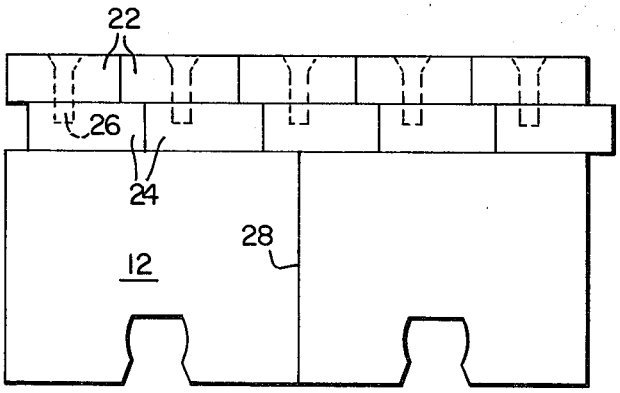
FIG. 4 is an expanded view of a modified reduction cathode according to the present invention.
Figure 5:
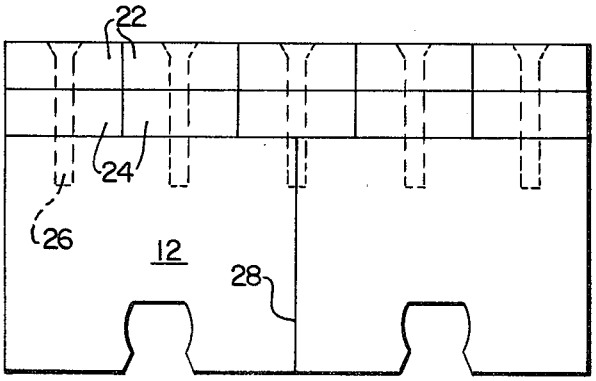
FIG. 5 is an expanded view of another modified reduction cathode according to the present invention.

As can best be seen in FIGS. 3–5, interposed between the carbonaceous cathode blocks 12 and the RHM tiles 22 are intermediate tiles 24. These tiles 24 are provided to eliminate the refractory hard metal-carbon interface which occurs when the RHM tile is directly fastened to the cathode blocks 12.

Materials which may be employed to form the intermediate tiles 24 include nitrides such as AlN, SiN, BN, TiN, ZrN and TaN, oxy-nitrides, such as $Si_2ON_2$, and such carbides as $Al_4C_3$, TiC, $B_4C$, $Zr_4C_3$, $Ta_2C$ and SiN bonded SiC.

The materials employed to form the intermediate tiles 24 do, themselves, have some solubility in the cryolite-molten alumina electrolyte. However, the solubility and solution rate of their reaction products is far lower than the solubility and solution rate of the reaction products of carbon at the RHM-carbon interface in the presence of the electrolyte and molten aluminum. Thus, their removal from the RHM-intermediate tile interface and from the intermediate tile-carbon interface will be slower, adding to the usable life span of the cell.

If the intermediate tile material employed is a good electrical conductor, the configurations shown in FIGS. 3 and 4 may be employed. In these configurations, the intermediate tile 24 is bonded, such as by a carbonaceous cement, to the cathode blocks 12. The RHM tiles 22 are then pinned to the intermediate tiles 26, by means such as pins 26 which may be formed of the RHM material. The FIG. 4 staggered tile seam configuration further reduces the possibility of the molten aluminum reaching the carbonaceous materials forming the cell bottom and reacting therewith.

If, however, the intermediate tile 14 is formed of a poor electrical conductor, in order to maintain the electrical circuit a configuration such as FIG. 5 is employed. In this configuration, the pins 26 employed to fasten the RHM tiles 22 to the intermediate tiles 24 extend through the intermediate tiles 24 and into the cathode blocks 12. Thus, electrical current is carried through these pins 26 from the RHM tile to the carbonaceous cathode blocks 12. Of course, the tile seams could be staggered, as in FIG. 4, as long as pins 26 extend into the carbonaceous blocks 12. Additionally, the intermediate tiles 24 may be bonded to the cathode blocks 12, in the same manner as previously described, as well as pinned to the cathode blocks 12.

FIGS. 3–5 also illustrate the substitution of a carbonaceous cement 28 for the rammed mixture 15 illustrated in FIG. 2 to form the bottom surface of the cell 1.

From the foregoing, it is clear that the present invention provides a simple, yet effective, means for preventing errosion at an RHM-carbon interface in an alumina reduction cell.

While presently preferred embodiments of the invention have been illustrated and described, it is clear that the invention may be otherwise variously embodied and practiced within the scope of the following claims.

I claim:

1. A cathode for an alumina reduction cell, said cathode comprising a carbonaceous bed, surface tiles, said surface tiles being formed from $TiB_2$ or $TiB_2$-AlN mixtures, and intermediate tiles connecting said surface tiles to said carbonaceous bed and separating said surface tiles from said carbonaceous bed, said intermediate tiles having a composition different from said surface tiles and selected from the group consisting of nitrides, oxy-nitrides and carbides, to prevent reaction between said surface tiles and said carbonaceous bed in the presence of molten aluminum.

2. The cathode of claim 1 wherein said intermediate tiles are attached to said surface tiles with pins and bonded to said carbonaceous bed.

3. The cathode of claim 2 wherein said intermediate tiles are bonded to said carbonaceous bed with a carbonaceous cement.

4. The cathode of claim 2 wherein said pins are formed from a refractory hard metal.

5. The cathode of claim 1 wherein said intermediate tiles are attached to said surface tiles and to said carbonaceous bed with pins.

6. The cathode of claim 5 wherein said pins are formed from a refractory hard metal.

7. The cathode of claim 5 wherein said intermediate tiles are bonded to said carbonaceous bed.

8. The cathode of claim 7 wherein said pins are formed from a refractory hard metal.

9. The cathode of claim 7 wherein said intermediate tiles are bonded to said carbonaceous bed with a carbonaceous cement.

10. The cathode of claim 1 wherein seams between said surface tiles and seams between said intermediate tiles are coplaner.

11. The cathode of claim 1 wherein seams between said surface tiles and seams between said intermediate tiles are staggered.

12. The cathode of claim 1 wherein said surface tiles are reinforced with fibers or particles.

13. The cathode of claim 1 wherein said cathode is a drained cathode.

14. In an alumina reduction cell, said cell comprising an anode, sidewalls and a cathode, the improvement wherein said cathode comprises a carbonaceous bed, surface tiles, said surface tiles being formed from $TiB_2$ or $TiB_2$-AlN mixtures, and intermediate tiles connecting said surface tiles to said carbonaceous bed and separating said surface tiles from said carbonaceous bed, said intermediate tiles having a composition different from said surface tiles and selected from the group consisting of nitrides, oxy-nitrides and carbides, to prevent reaction between said surface tiles and said carbonaceous bed in the presence of molten aluminum.

15. The reduction cell of claim 14 wherein said intermediate tiles are attached to said surface tiles with pins and bonded to said carbonaceous bed.

16. The reduction cell of claim 15 wherein said intermediate tiles are bonded to said carbonaceous bed with a carbonaceous cement.

17. The reduction cell of claim 15 wherein said pins are formed from a refractory hard metal.

18. The reduction cell of claim 14 wherein said intermediate tiles are attached to said surface tiles and to said carbonaceous bed with pins.

19. The reduction cell of claim 18 wherein said pins are formed from a refractory hard metal.

20. The reduction cell of claim 18 wherein said intermediate tiles are bonded to said carbonaceous bed.

21. The reduction cell of claim 20 wherein said pins are formed from a refractory hard metal.

22. The reduction cell of claim 20 wherein said intermediate tiles are bonded to said carbonaceous bed with a carbonaceous cement.

23. The reduction cell of claim 14 wherein seams between said surface tiles and seams between said intermediate tiles are coplanar.

24. The reduction cell of claim 14 wherein seams between said surface tiles and seams between said intermediate tiles are staggered.

25. The reduction cell of claim 14 wherein said surface tiles are reinforced with fibers or particles.

26. The reduction cell of claim 14 wherein said cathode is a drained cathode.

* * * * *